US012709510B2

(12) United States Patent
Tokuno et al.

(10) Patent No.: US 12,709,510 B2
(45) Date of Patent: Aug. 18, 2026

(54) SHEET PROCESSING APPARATUS, IMAGE FORMING SYSTEM, AND STORAGE MEDIUM

(71) Applicant: Konica Minolta, Inc., Tokyo (JP)

(72) Inventors: Toshiyuki Tokuno, Hino (JP); Kenichi Yamada, Higashiyamato (JP)

(73) Assignee: KONICA MINOLTA, INC., Tokyo (JP)

( * ) Notice: Subject to any disclaimer, the term of this patent is extended or adjusted under 35 U.S.C. 154(b) by 181 days.

(21) Appl. No.: 18/809,192

(22) Filed: Aug. 19, 2024

(65) Prior Publication Data

US 2025/0074737 A1 Mar. 6, 2025

(30) Foreign Application Priority Data

Aug. 29, 2023 (JP) ..... 2023-138761

(51) Int. Cl.
*B65H 35/04* (2006.01)
*B65H 35/02* (2006.01)

(52) U.S. Cl.
CPC ..... *B65H 35/04* (2013.01); *B65H 35/02* (2013.01); *B65H 2301/333* (2013.01); *B65H 2511/413* (2013.01); *B65H 2553/45* (2013.01); *B65H 2701/1311* (2013.01); *B65H 2701/1313* (2013.01)

(58) Field of Classification Search
CPC ..... B65H 35/02; B65H 35/04
USPC ..... 270/52.17
See application file for complete search history.

(56) References Cited

U.S. PATENT DOCUMENTS 11,535,478 B2 * 12/2022 Ohashi ..... B41J 11/706
11,753,269 B2 * 9/2023 Asakawa ..... G03G 15/6582 270/30.08
2020/0096929 A1 * 3/2020 Ueda ..... B65H 39/06

FOREIGN PATENT DOCUMENTS

JP 2021-091010 A 6/2021

* cited by examiner

*Primary Examiner* — Michael Mccullough
(74) *Attorney, Agent, or Firm* — Squire Patton Boggs (US) LLP

(57) ABSTRACT

Provided is a sheet processing apparatus including: a sheet processing section that performs sheet processing on a conveyed sheet along a width direction orthogonal to a conveyance direction of the conveyed sheet; and a hardware processor that sets a sheet processing position from a leading end or a trailing end in the conveyance direction and that reverses the set sheet processing position in the conveyance direction of the sheet according to a direction of a face of the conveyed sheet.

17 Claims, 9 Drawing Sheets

SHEET PROCESSING APPARATUS, IMAGE FORMING SYSTEM, AND STORAGE MEDIUM

CROSS-REFERENCE TO RELATED APPLICATIONS

The entire disclosure of Japanese Patent Application No. 2023-138761 filed on Aug. 29, 2023 is incorporated herein by reference in its entirety.

TECHNICAL FIELD

The present invention relates to a sheet processing apparatus, an image forming system, and a storage medium.

DESCRIPTION OF RELATED ART

Conventionally, there have been known sheet processing apparatuses that convey sheets by a conveyance roller and perform predetermined processing on the sheet. Sheet processing apparatuses include, for example, a cutting apparatus that cuts sheets at cutting positions. In the cutting apparatus, a plurality of cutting positions are set in a direction orthogonal to the conveyance direction of the sheet with reference to the leading end of the sheet in the conveyance direction, and the sheet is cut a plurality of times.

For example, Japanese Unexamined Patent Publication No. 2021-091010 teaches that a sheet with an image formed side up is conveyed to the cutting apparatus, and the cutting apparatus cuts the sheet at a set cutting positions.

SUMMARY OF THE INVENTION

The setting of the cutting positions is manually done because it is necessary to consider variations unique to the cutting machine to be used.

Even sheets on which the same image is formed have different image orientations when the sides (face-up/face-down) of the sheets received by the cutting apparatus are different. Therefore, in order to perform cutting at target positions, it is necessary to set cutting positions corresponding to the respective sheet faces (sides). That is, when the front and back are inverted, the cutting positions are manually and separately set.

Furthermore, in an inline machine, the side of the sheet at the time of cutting is determined according to the setting of the job and the configuration of the sheet cutting system. However, it is difficult for the user to grasp the sheet face at the time of cutting.

Therefore, an object of the present invention is to further simplify the setting of the position of sheet processing to be applied to a sheet.

To achieve at least one of the abovementioned objects, according to an aspect of the present invention, a sheet processing apparatus reflecting one aspect of the present invention includes:

- a sheet processing section that performs sheet processing on a conveyed sheet along a width direction orthogonal to a conveyance direction of the conveyed sheet; and
- a hardware processor,
- wherein the hardware processor:
  - sets a sheet processing position from a leading end or a trailing end in the conveyance direction; and
  - reverses the set sheet processing position in the conveyance direction of the sheet according to a direction of a face of the conveyed sheet.

To achieve at least one of the abovementioned objects, according to another aspect of the present invention, an image forming system reflecting one aspect of the present invention includes:

- an image forming apparatus; and
- the sheet processing apparatus described above,
- wherein the image forming apparatus includes:
  - an image forming section that forms an image on a sheet; and
  - a sheet reversing section that reverses the sheet on which the image is formed by the image forming section,
- wherein the sheet processing apparatus performs sheet processing on the sheet on which the image has been formed by the image forming apparatus.

To achieve at least one of the abovementioned objects, according to another aspect of the present invention, a storage medium reflecting one aspect of the present invention stores a program for a computer of a sheet processing apparatus,

- wherein the sheet processing apparatus comprises a sheet processing section that performs sheet processing on a conveyed sheet along a width direction orthogonal to a conveyance direction of the conveyed sheet,
- wherein the program causes the computer to:
  - set a sheet processing position from a leading end or a trailing end in the conveyance direction; and
  - reverse the set sheet processing position in the conveyance direction of the sheet according to a direction of a face of the conveyed sheet.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention, wherein.

DETAILED DESCRIPTION

In the following, embodiments of the present invention will be described in detail with reference to the drawings. However, the scope of the invention is not limited to the illustrated examples.

[Outline of Image Forming System; Part 1]

First, a configuration of an image forming system 100 will be described with reference to FIGS. 1 and 2.

Figure 1:
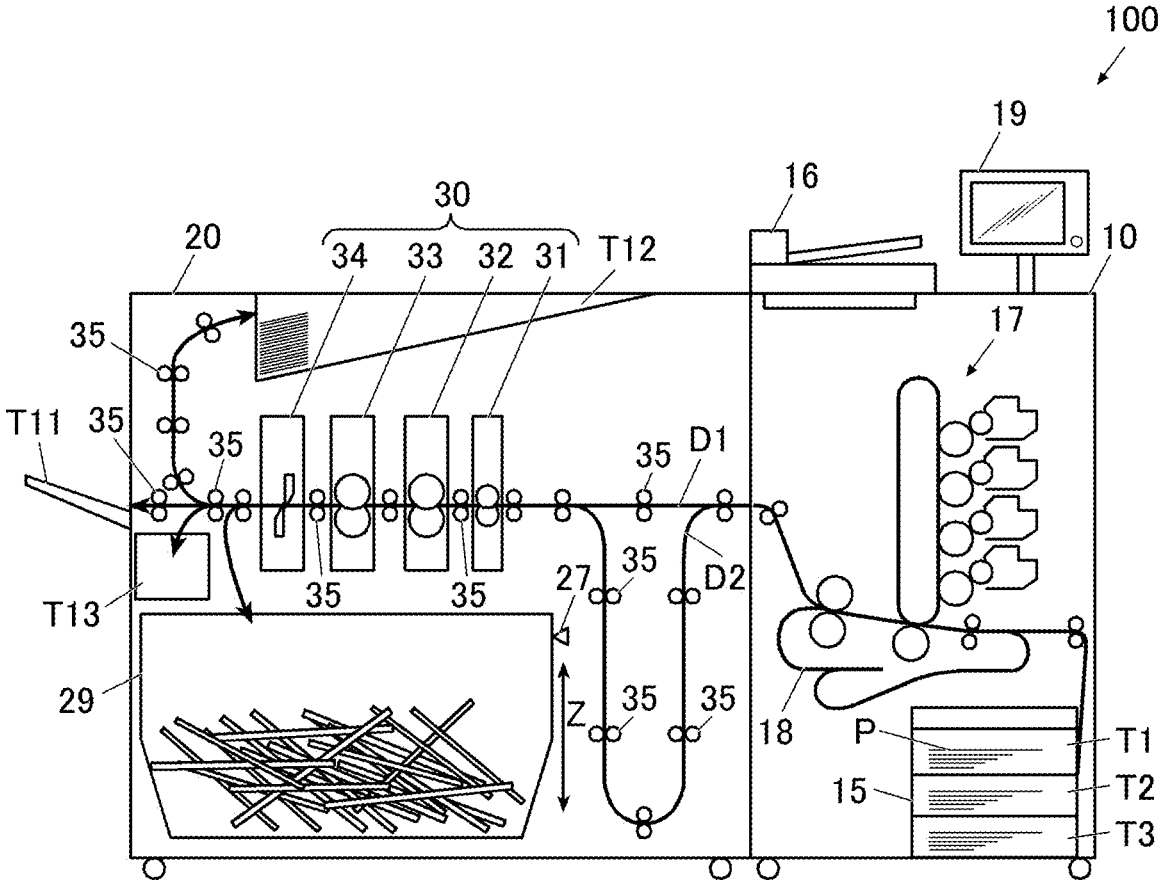
FIG. 1 is a diagram of a configuration of an image forming system in an embodiment of the present invention.
Figure 2:
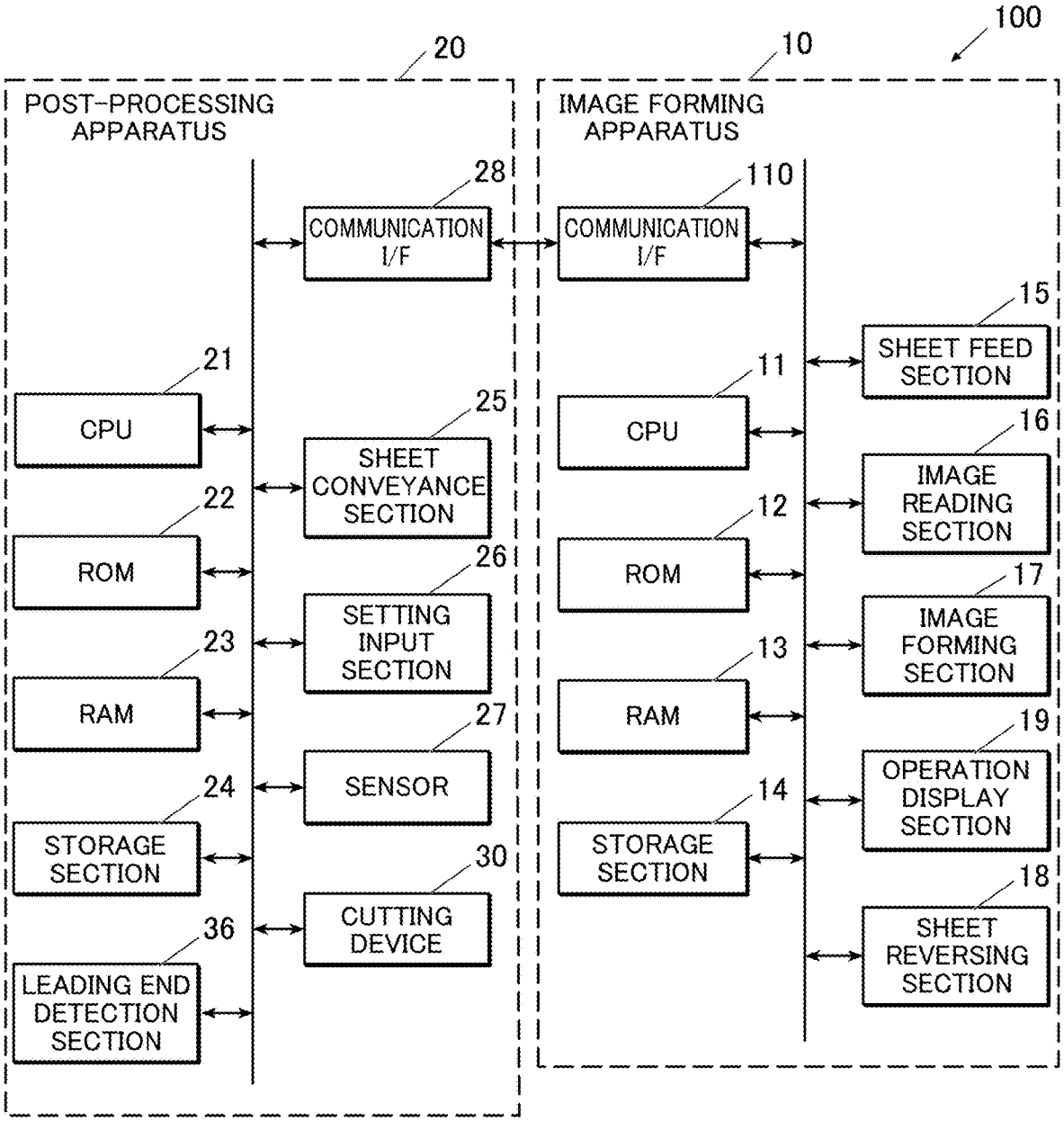
FIG. 2 is a block diagram illustrating a functional configuration of the image forming system.

FIG. 1 is a configuration diagram of the image forming system 100 according to an embodiment of the present invention. FIG. 2 is a block diagram illustrating a functional configuration of the image forming system 100.

The image forming system 100 includes an image forming apparatus 10 that performs image formation processing on a paper sheet P serving as a sheet, and a sheet processing apparatus 20 that performs sheet processing on the sheet P on which an image has been formed by the image forming apparatus 10. The sheet processing includes cutting processing, creasing processing, perforation forming processing, and the like.

The following description will be given using a case where the sheet processing is cutting processing.

[Image Forming Apparatus]

The image forming apparatus 10 forms an image on a sheet P in accordance with an image forming command received from a personal computer (PC) or the like via a communication network. The image forming apparatus 10 conveys the sheet P after image formation to the sheet processing apparatus 20.

The image forming apparatus 10 includes a central processing unit (CPU) 11, a read only memory (ROM) 12, a random access memory (RAM) 13, a storage section 14, a sheet feed section 15, an image reading section 16, an image forming section 17, a sheet reversing section 18, an operation display section 19, a communication interface (I/F) 110, and the like.

The CPU 11 reads a program stored in the ROM 12, deploys the program in the RAM 13, and controls an operation of each part of the image forming apparatus 10 in cooperation with the deployed program.

The ROM 12 is formed with a non-volatile memory or the like, and stores a system program and various processing programs executable on the system program, various kinds of data, and the like.

The RAM 13 is composed of a volatile semiconductor memory and the like, and forms a work area for temporarily storing programs read from the CPU 11, input or output data, parameters and the like in various kinds of processing executed by the ROM 12.

The storage section 14 includes a hard disk drive (HDD) and a non-volatile semiconductor memory, and stores various types of data.

The sheet feed section 15 includes a plurality of sheet feed trays T1 to T3 that can store sheets P different in size, type (paper type), basis weight, and the like, and feeds the sheet P stored in a specified one of the sheet feed trays T1 to T3 to the image forming section 17.

The image reading section 16 generates image data by reading a document. Specifically, the image reading section 16 reads, with a charge coupled device (CCD) image sensor or the like, light emitted from a light source and reflected by the document.

The image forming section 17 forms an image on the sheet P. The image forming section 17 charges the photoreceptor with the charging section, forms an electrostatic latent image by exposing and scanning the photoreceptor with a laser beam emitted from the exposure section based on image data, develops the electrostatic latent image with a toner by the developing section, transfers the toner image onto the sheet P by the transfer section, and fixes the toner image onto the sheet P by the fixing section.

The sheet reversing section 18 inverts the front and back of the sheet that has passed through the image forming section 17, and conveys the sheet again to the image forming section 17.

The operation display section 19 includes a display section that is configured by a liquid crystal display (LCD) to display various screens, and an operation receiver configured by a touch screen superimposed on the display section and various keys. The operation display section 19 outputs, to a central processing unit (CPU) 11, an operation signal input by a touch operation or a key operation (see FIG. 2).

The communication I/F 110 is configured by a network interface card (NIC), a modem, or the like, and performs data transmission and reception with the sheet processing apparatus 20 and personal computers (PCs).

[Sheet Processing Apparatus]

The sheet processing apparatus 20 is a cutting machine that performs cutting processing on a sheet P. The sheet processing apparatus 20 performs cutting processing on the sheet P carried in from the image forming apparatus 10 as necessary, and discharges a product created by the cutting processing to the sheet ejection tray T11 or T12 or the card tray T13.

The sheet processing apparatus 20 includes a CPU 21 (hardware processor), a ROM 22, a RAM 23, a storage section 24, a sheet conveyance section 25, a setting input section 26, a communication I/F 28, a cutting device 30 as a sheet processing section, a leading end detection section 36, and the like.

The CPU 21, ROM 22, and RAM 23 are the same as the CPU 11, ROM 12, and RAM 13 except that the control target of the CPU 21 is the sheet processing apparatus 20.

The CPU 21 functions as a setter that sets a cutting position as a sheet processing position from the leading end or the trailing end of the sheet in the conveyance direction.

The CPU 21 functions as a position reversing section that reverses the set cutting position in the conveyance direction of the sheet according to the direction of the face of the conveyed sheet.

The CPU 21 functions as a correction section that corrects, by a user operation, the sheet processing position set by the setting section.

The CPU 21 functions as a display controller that causes the display part to display whether the sheet processing position is corrected with the reference of the leading end position or the trailing end position at the time of correction by the correction section.

The CPU 21 functions as a determination section that determines, from a job with cutting of a sheet, the face of the sheet when the sheet reaches the cutting section, based on the image forming face and the number of times of reversing the front and back of the sheet from after the image formation to when the sheet reaches the cutting position.

The storage section 24 is formed with an HDD, a non-volatile semiconductor memory, or the like, and stores various types of data.

The storage section 24 functions as a storage section that stores the cutting position and the direction of the sheet face set by the setting section.

The sheet conveyance section 25 includes a plurality of conveyance rollers 35 provided along conveyance paths D1 and D2, and conveys the sheet P conveyed from the image forming apparatus 10 until it is ejected to the sheet ejection tray T11 or T12 or the card tray T13.

The sheet conveyance section 25 functions as a conveyance section and is formed with components including at least one of a conveyance roller and a conveyance belt.

The conveyance path D1 is provided side by side with a long sheet conveyance path D2 that is branched from the conveyance path D1 and merges with it on the downstream. The long sheet conveyance path D2 is used as a buffer when a long sheet is conveyed.

Further, in the conveyance paths D1 and D2, conveyance rollers 35 that convey the sheet P by rotation of a pair of rollers provided so as to sandwich the sheet P from the front and back at a predetermined interval along each path are provided. In addition, the conveyance paths D1 and D2 may be provided with a conveyance belt that transports the sheet P placed thereon.

Here, a driving motor for driving is connected to the conveyance rollers 35 and the conveyance belt. The conveyance roller 35 and the conveyance belt are driven by the operation of the driving motor.

The setting input section 26 includes a display section that is configured by an LCD to display various screens, and an operation receiver configured by a touch screen superimposed on the display section and various keys. The setting input section 26 outputs, to the CPU 21, operation signals input by a touch operation or a key operation.

The communication I/F 28 as a communication section is configured by an NIC, a modem, or the like, and performs data transmission and reception with the image forming apparatus 10.

The cutting device 30 performs cutting processing of cutting the sheet P to be conveyed. The cutting device 30 includes FD-cutting sections 31 to 33 as second cutting sections and a CD-cutting section 34 as a first cutting section at a plurality of positions on the conveyance path D1 of the sheet P.

The FD cutting sections 31 to 33 are slitters that cut the sheet P along a conveyance direction (feed direction) F. Each of the FD cutting sections 31 and 32 is a top and bottom slitter that cuts an end portion (back side and front side) in a direction C (direction orthogonal to conveyance) that is parallel to the plane of the sheet P and orthogonal to the conveyance direction F. The FD cutting section 33 is a bleed cutting slitter that cuts, along the conveyance direction F, a margin between products adjacent to each other in the orthogonal-to-conveyance direction C of the sheet P.

The FD cutting sections 31 to 33 include, for example, an actuator such as a motor (not illustrated), and can adjust a cutting position in the orthogonal-to-conveyance direction C within a specified range. Accordingly, it is possible to perform cutting along the conveyance direction F at a position which is at a prescribed distance from both end portions of the sheet P in the orthogonal-to-conveyance direction C.

The CD cutting section 34 is a guillotine cutter that cuts the sheet P along the orthogonal-to-conveyance direction C. The CD cutting section 34 can arbitrarily adjust a cutting position in the conveyance direction F of the sheet P in cooperation with the conveyance roller 35.

The leading end detector 36 is provided at a position right before the cutting device 30 in the conveyance path D1. The leading end detector 36 is a sensor that detects the leading end of the sheet P conveyed. For example, any sensor capable of detecting the passing of the leading end portion of the sheet P can be used. For example, a photointerrupter that optically detects the tip portion, a microswitch that detects the tip portion by contact, or the like can be given as an example.

The CPU 21 can recognize where in the conveyance path D1 the leading end of the sheet P is located by reading the number of driving rotations, driving time, and the like of each conveyance roller 35 after the detection of the leading end of the sheet P by the leading end detector 36. Then, the CPU 21 controls the cutting sections 31 to 34 of the cutting device 30 to cut the conveyed sheet P at appropriate timings.

In the above description, the cutting device 30 is described as an example of the sheet processing section, but the invention is not limited thereto. The sheet processing section may be a creasing device or a perforation forming device.

The scrap box 29 is installed below the cutting device 30, and stores cutting scrap that is generated in a cutting operation by the cutting device 30 and drops from the cutting device 30. A user opens the door of the sheet processing apparatus 20, takes out the scrap box 29, and discards the cutting scrap in the scrap box 29.

[Cutting Processing]

Figure 3:
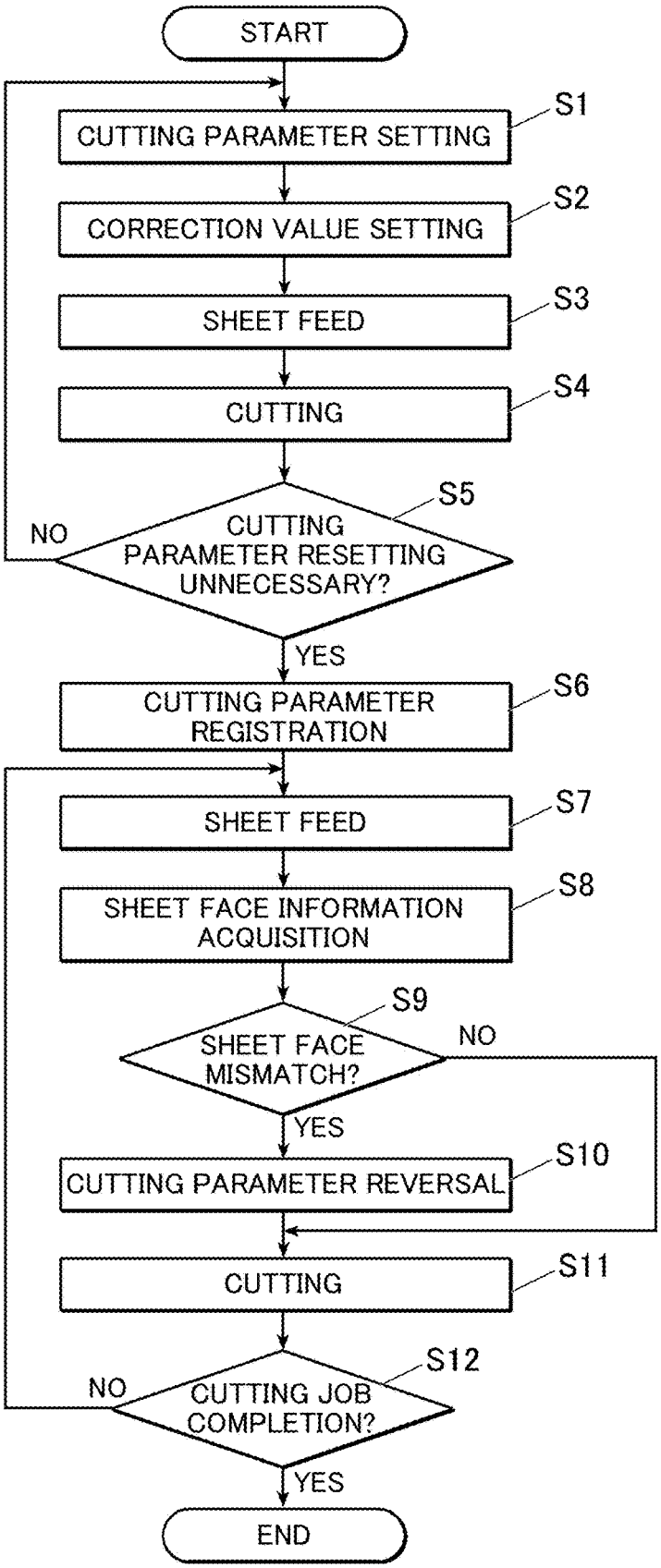
FIG. 3 is a flowchart of the cutting processing.

The cutting processing performed in the sheet processing apparatus 20 will be described with reference to FIG. 3.

Figure 4:
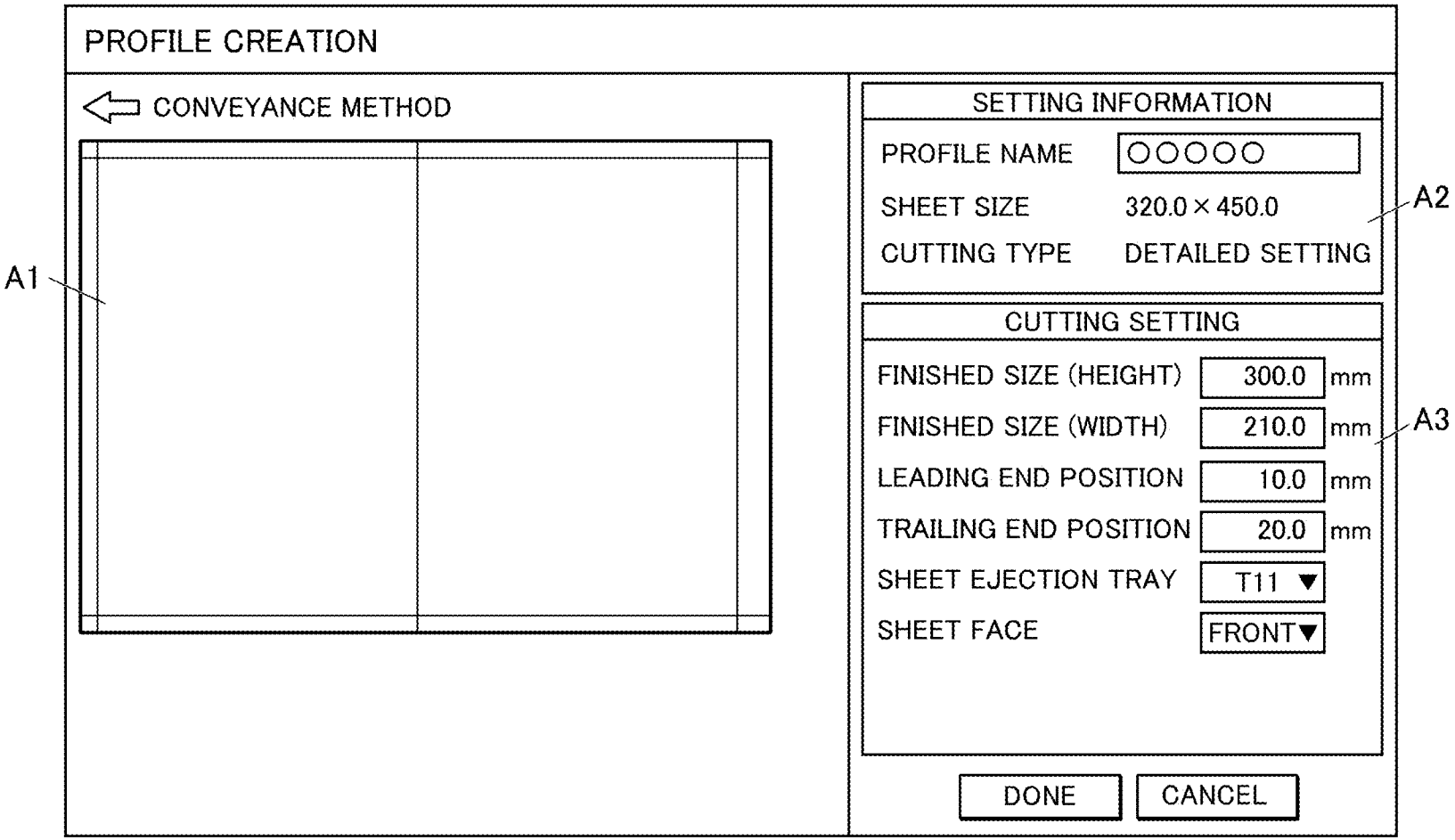
FIG. 4 is an image diagram of a cutting parameter setting screen.

First, the CPU 21 causes the setting input section 26 to display a cutting parameter setting screen shown in FIG. 4. Based on the cutting parameters input from the cutting parameter setting screen by a user, the CPU 21 sets the cutting parameters in the sheet processing apparatus 20 (Step S1).

Here, the cutting parameter setting screen will be described with reference to FIG. 4.

The area A1 is an area for displaying an image of a cutting profile. A part indicated by a thick line is an image of the sheet before cutting. A part indicated by a thin line is an image of a cutting position.

The area A2 is an area for displaying general setting information of the cutting profile. The general setting information is information such as a profile name and a sheet size, for example.

The area A3 is an area for displaying cutting setting information of the cutting profile. As the cutting setting information, for example, cutting parameters such as a finished size (width), a finished size (height), a leading end position, a trailing end position, a sheet ejection tray, and a sheet surface are set. In this example, the sheet is divided into a plurality of pieces in the conveyance direction, and a sheet having a size of 450.0 mm in the conveyance direction (width) is cut into two sheets having a size of 210.0 mm (finished size (width)). The cut sheet is ejected to a sheet ejection tray T11 with the front face up.

When the sheet is to be divided into a plurality of pieces, the area A3 may be an area for prompting a user to input the number of pieces into which the sheet is to be divided.

Figure 5:
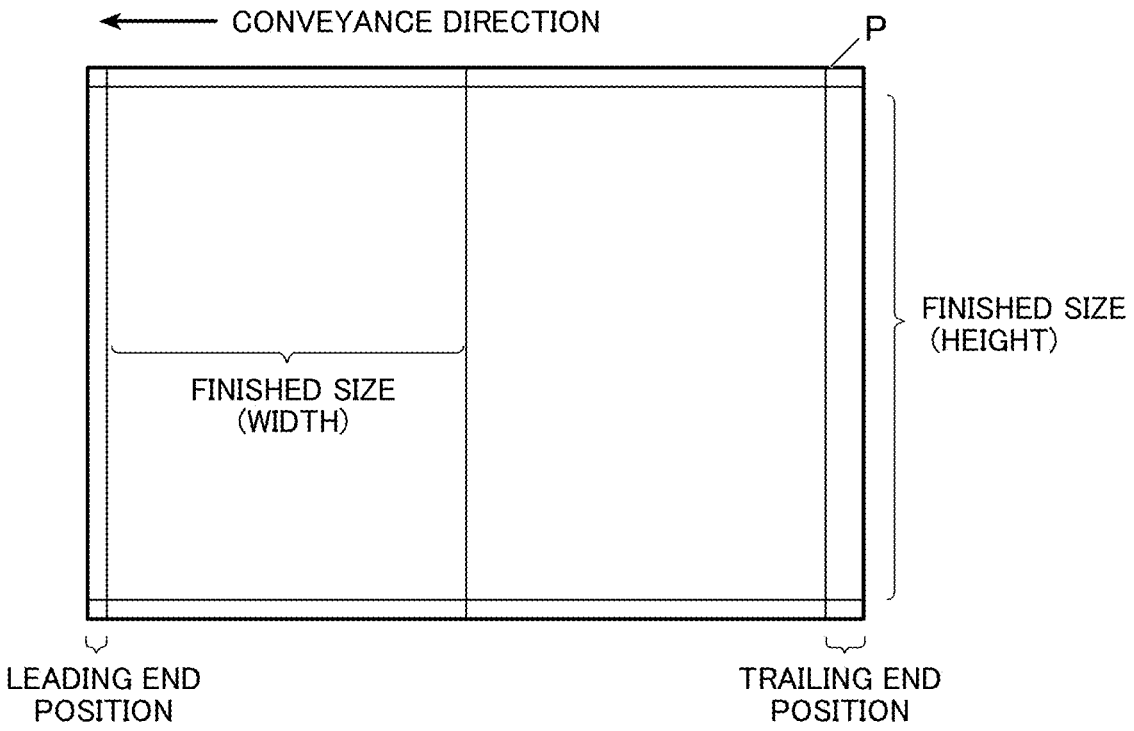
FIG. 5 is an image diagram showing a relationship between cutting parameters and sheets.

The relationship between the cutting parameters and the sheet is described with reference to FIG. 5.

The leading end position is a position at which the front end portion of the sheet is cut in the orthogonal-to-conveyance direction.

The finished size (width) is the length of the sheet in the conveyance direction after cutting.

The finished size (height) is the length of the cut sheet in the orthogonal-to-conveyance direction (width direction).

The trailing end position is a position at which the trailing end portion of the sheet is cut in the orthogonal-to-conveyance direction.

A user inputs numerical values of the above-described parameters from the touch screen or various keys of the setting input section 26. In the example of FIG. 5, the length is set by a unit of 0.1 mm.

Figure 6:
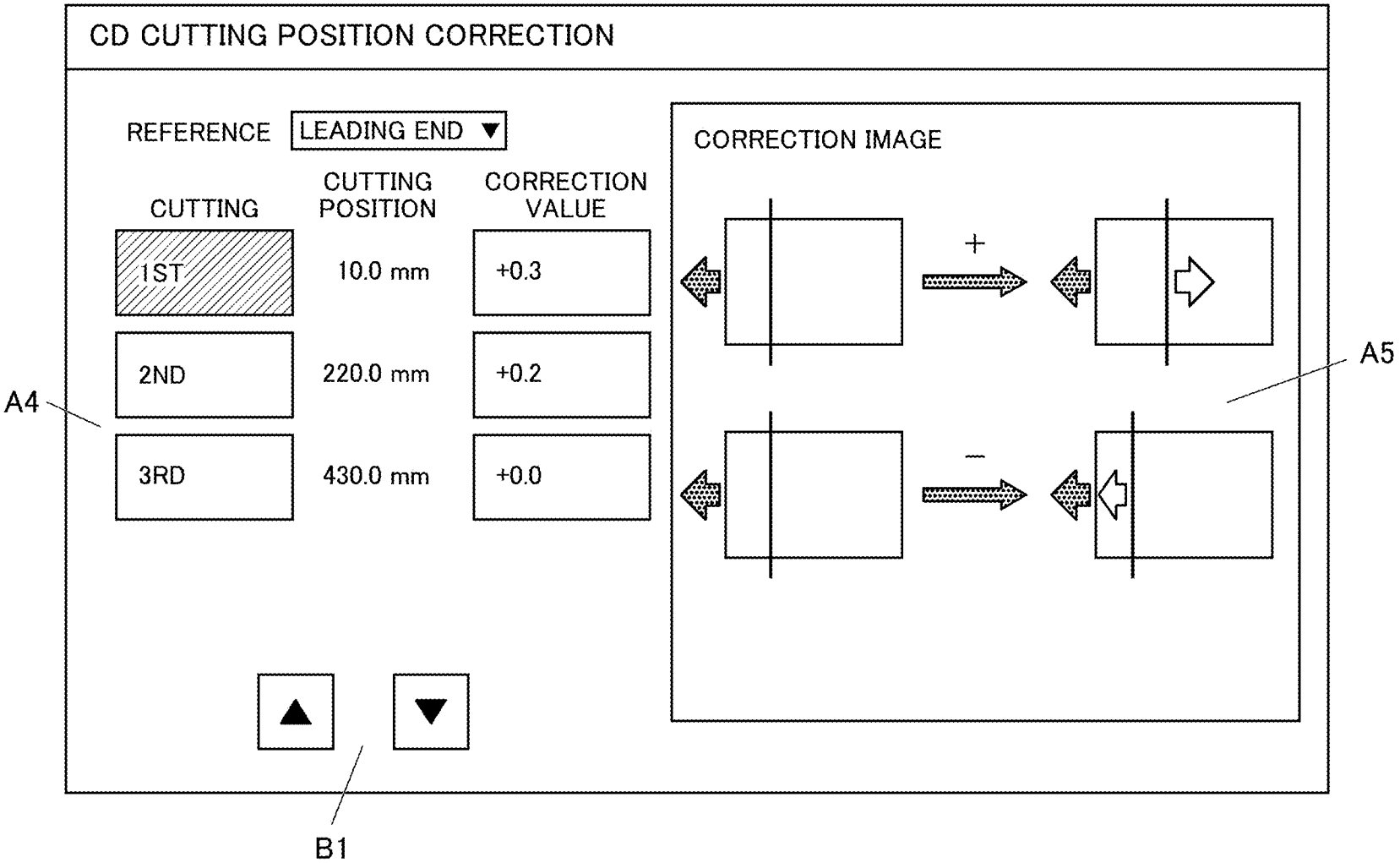
FIG. 6 is an image diagram of a cutting position correction screen.

Next, the CPU 21 allows the setting input section 26 to display a cutting position correction screen illustrated in FIG. 6.

Based on the correction values input by a user through the cutting position correction screen, the CPU 21 sets the correction values in the sheet processing apparatus 20 (Step S2).

Here, the cutting position correction screen will be described with reference to FIG. 6.

The area A4 is an area for performing adjustment work of the cutting positions on the FD-direction side (CD-cutting position correction). In the example of FIG. 6, how much the first, second to Nth cutting positions from the leading end are corrected with the leading end position as a reference in the area A4 is shown. A user inputs a correction value for each cutting position using the setting input section 26. In the field of the correction value, "+" and "−" indicate "the direction opposite to the conveyance direction" and "the conveyance direction", respectively, when the reference is the leading end, and they indicate "the conveyance direction" and "the direction opposite to the conveyance direction", respectively, when the reference is the rear end.

Figure 7:
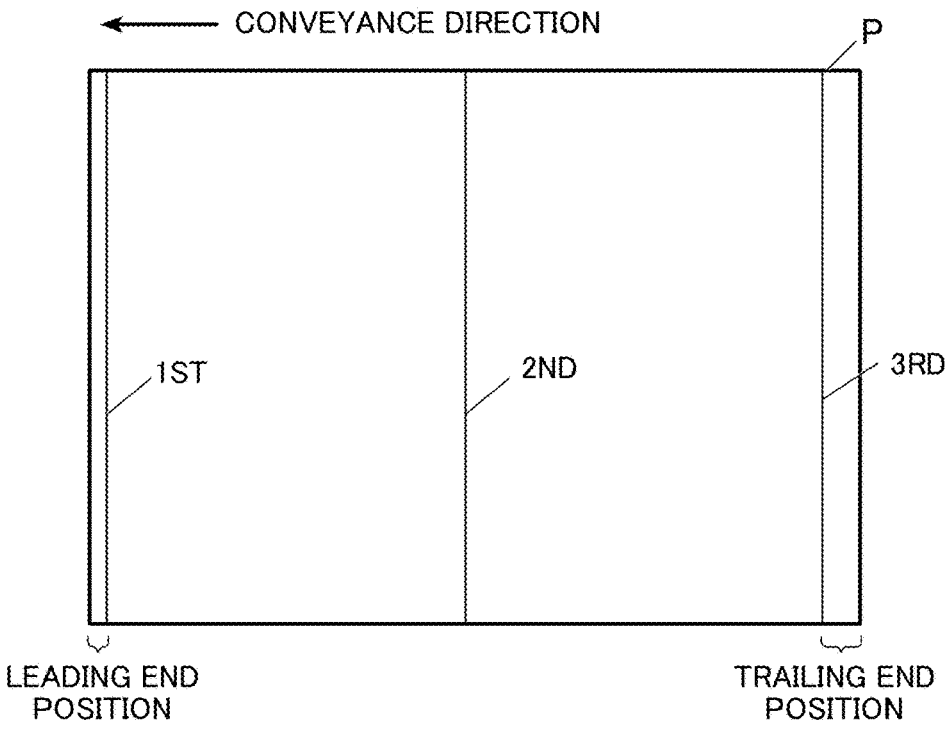
FIG. 7 is an image diagram of a correction value application position when a leading end position is a reference.
Figure 8:
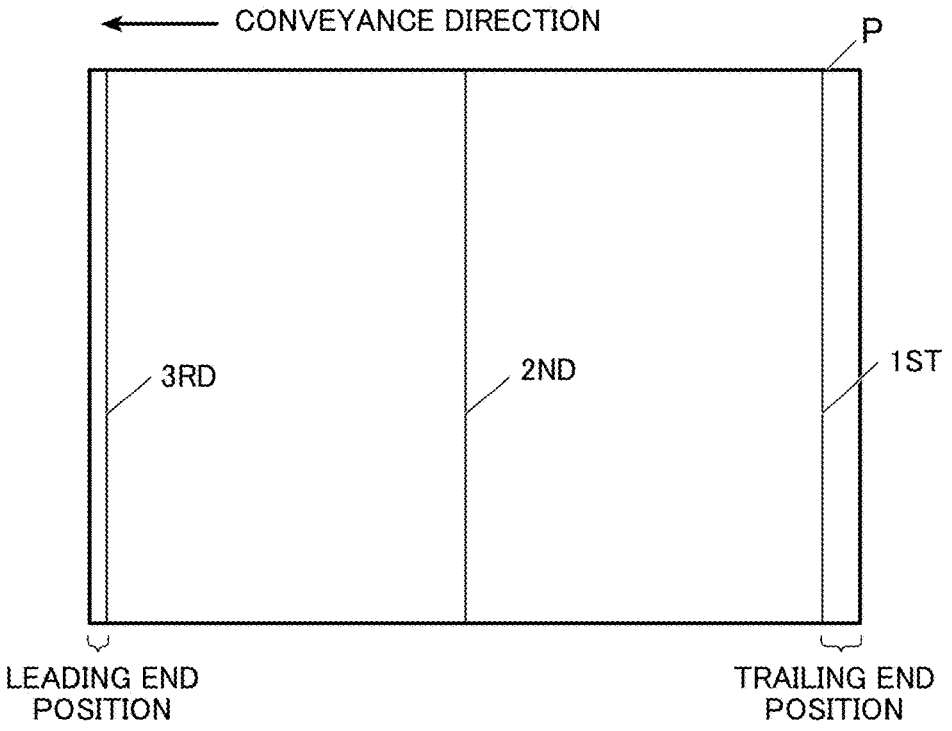
FIG. 8 is an image diagram of a correction value application position when a trailing end position is a reference.

Images of the first, second to Nth cutting positions from the leading end are illustrated in FIG. 7. FIG. 7 is an image diagram of a correction value application position when a leading end position is a reference. The images of the first, second, and Nth cutting positions from the trailing end are as shown in FIG. 8. FIG. 8 is an image diagram of a correction value application position when a trailing end position is a reference. Whether to use the leading end position reference or the trailing end position reference can be selected from a pull-down menu in a reference field on the cutting position correction screen from the setting input section 46.

To be specific, the cutting positions determined by the cutting parameters input from the cutting parameter setting screen illustrated in FIG. 4 are 10.0 mm (first), 220.0 mm (second), and 430.0 mm (third) when the leading end in the conveyance direction is used as a reference. On the other hand, the cutting positions are 440.0 mm (first), 230.0 mm (second), and 20.0 mm (third) when the trailing end in the conveyance direction is used as a reference.

The CPU 21 applies, to the cutting position, the correction amount by "+" in the opposite direction to the conveyance direction and by "−" in the same direction as the conveyance direction in the example of FIG. 6. In the example of FIG. 6, the setting is performed by a unit of 0.1 mm. That is, in the example of FIG. 6, since the first position is +0.3, the CPU 21 causes the cutting device 30 to perform cutting aiming at a position of 10.3 mm, which is +0.3 mm with respect to the target leading end position 10 mm.

The area A5 is an area indicating the cutting positions before and after the correction amount is reflected, in a case where the correction amount is reflected in the cutting positions.

The up and down buttons B1 are buttons for changing to which cutting position (Nth cutting position) the correction value is input. When the up button is pressed, the input field moves upward, and when the down button is pressed, the input field moves downward.

Next, the CPU 21 drives the sheet conveyance section 25 to move the sheet to the cutting device 30 (Step S3).

Next, the CPU 21 drives the cutting device 30 to cut the sheet at the cutting position (Step S4).

Figure 9:
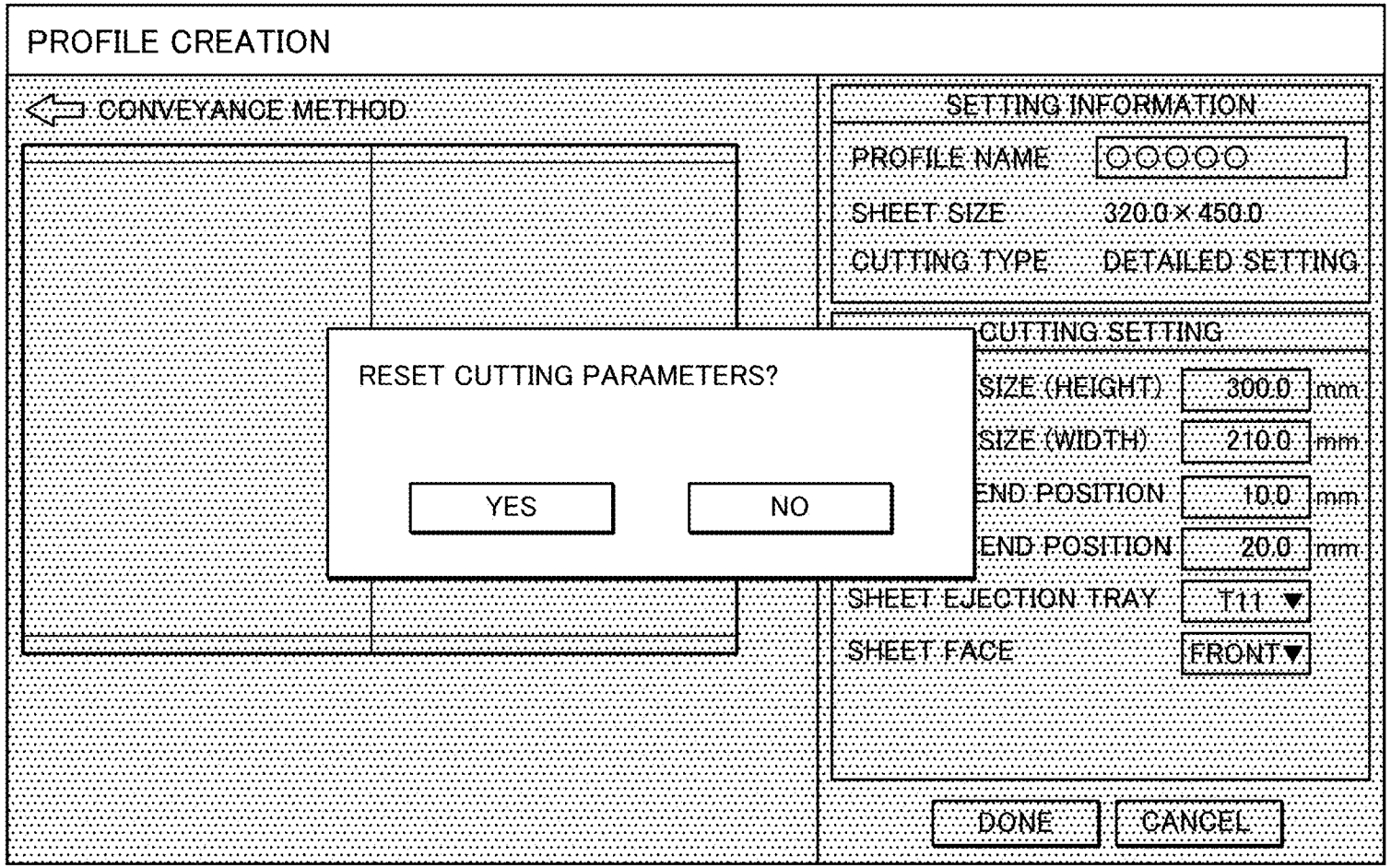
FIG. 9 is an image diagram of a reflection propriety check screen.

Next, the CPU 21 allows the setting input section 26 to display a reflection propriety check screen illustrated in FIG. 9. Based on the user's input to the reflection propriety check screen, the CPU 21 determines whether or not the cutting parameters need to be reset (Step S5). If resetting is not necessary (step S5; YES), the CPU 21 advances the cutting processing to Step S6. If resetting is necessary (Step S5; NO), the CPU 21 advances the cutting processing to Step S1.

Here, the reflection propriety check screen illustrated in FIG. 9 will be described.

The pop-up P1 is a pop-up asking a user whether to reset the cutting parameters. When "YES" is pressed, the CPU 21 advances the cutting processing to Step S1. When "No" is pressed, the CPU 21 advances the cutting processing to Step S6.

Next, the CPU 21 stores the cutting parameters in the storage section 24 (Step S6).

Next, the CPU 21 causes the next sheet to be fed from the image forming apparatus 10 via the communication section.

Next, the CPU 21 acquires information on the face (side) of the sheet (sheet face information) (Step S8). The CPU 21 counts the number of times of reversing in the sheet reversing section 18 to determine which side of the sheet having reached the cutting device 30 is directed upward or downward, and acquires sheet face information.

Next, the CPU 21 compares the acquired sheet face information with the sheet face information stored in step S6 (step S9). The acquired sheet face information and the sheet face information stored in Step S6 are compared, and if they are the same (Step S9; YES), the CPU 21 proceeds to Step S11 to perform cutting processing. The acquired sheet face information and the sheet face information stored in Step S6 are compared, and if they are different (Step S9; NO), CPU 21 proceeds to Step S10 to perform cutting processing.

Next, the CPU 21 reverses the cutting parameters (Step S10).

To be more specific, when the cutting positions are set using the leading end position as the reference, the CPU 21 resets the cutting positions with the trailing end position as the reference. On the other hand, when the cutting positions are set using the trailing end position as the reference, the CPU 21 resets the cutting position with the leading end position as the reference. In a case where the correction amount is set, "+" and "−" of the correction value at each cutting position are inverted for the correction amount as well.

Next, the CPU 21 causes the cutting device 30 to cut the sheet (Step S11).

Finally, the CPU 21 checks whether the cutting jobs have been all completed (Step S12). If the cutting jobs have been all completed (Step S12; YES), the CPU 21 ends the cutting processing. If the cutting jobs have not been all completed (Step S12; NO), the CPU 21 advances the cutting processing to Step S7.

Thus, the user does not have to set each of the cutting positions from the leading end position or the trailing end position in consideration of the direction in which the sheet is conveyed. That is, if the cutting position is set with one of the leading end position and the trailing end position as the reference, the cutting position is then automatically maintained or reversed, thereby saving time and labor.

Further, in the cutting device, a discharge destination such as a conveyance path and a discharge tray may be changed by a job configuration or the like, and the sheet may be inversed at the time of cutting. Also in this case, although the user cannot recognize the inversion, no problem arises because the cutting position is automatically set.

[Outline of Image Forming System; Part 2]

Figure 10:
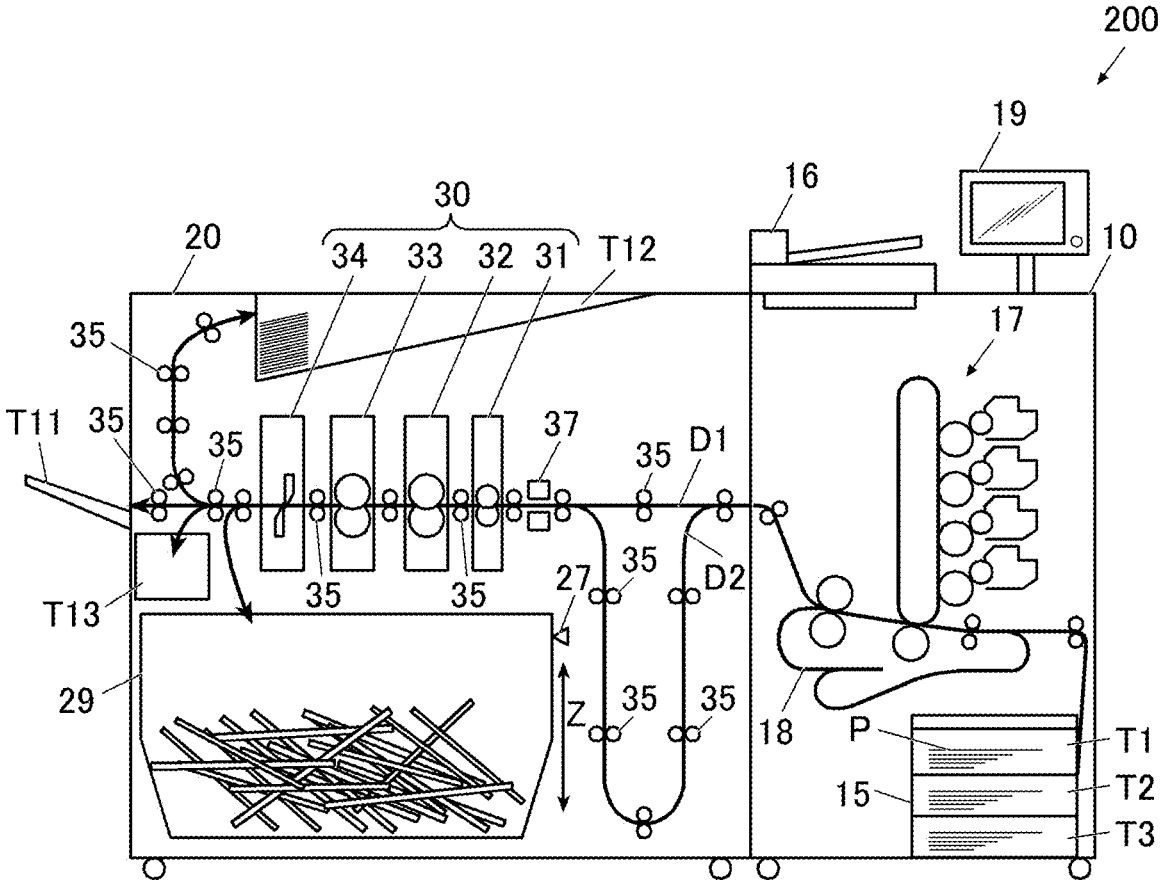
FIG. 10 is a diagram of a configuration of the image forming system in an embodiment of the present invention.

FIG. 10 is a configuration diagram of an image forming system 200 according to an embodiment of the present invention. The image forming system 200 includes an image reading device 37 in addition to the image forming system 100. The other configuration is the same as that of the image forming system 100.

The image reading device 37 is a device that reads an image on the sheet P which is conveyed by the sheet conveyance section 25 and on which the image is formed by the image forming apparatus 10. That is, the image reading device 37 can acquire which side of the sheet P the image is formed on (sheet face information).

The cutting processing in the image forming system 200 is different from the cutting processing in the image forming system 100 in the processing in Step S9. The other steps are the same.

As described above, in Step S9, in the image forming system 100, the CPU 21 counts the number of times of reversing in the sheet reversing section 18, thereby determining which side of the sheet that has reached the cutting device 30 is facing upward or downward.

In the image forming system 200, the CPU 21 acquires the sheet face information of the sheet P conveyed from the image reading device 37, and determines which side of the sheet that has reached the cutting device 30 is facing upward or downward.

Effects

As described hereinbefore, the sheet processing apparatus 20 includes: the sheet processing section (cutting device 30) that performs sheet processing on a conveyed sheet along a width direction orthogonal to a conveyance direction of the conveyed sheet; the setter (CPU 21); and the position reversing section (CPU 21). The setter sets a sheet processing position from a leading end or a trailing end in the conveyance direction. The position reversing section reverses the set sheet processing position in the conveyance direction of the sheet according to a direction of a face of the conveyed sheet. Therefore, it is possible to more easily set the position of the sheet processing to be performed on the sheet.

The sheet processing apparatus 20 includes the storage section 24 that stores the sheet processing position and the direction of the face of the sheet which are set by the hardware processor.

The position reversing section (CPU 21) compares the direction of the face of the conveyed sheet and the direction of the face of the sheet stored in the storage section, and when the direction of the sheet conveyed and the direction stored in the storage section are different from each other, the hardware processor reverses the sheet processing position set by the setter. Therefore, the user does not need to keep track of the sheet side at the time of cutting. Furthermore, it is possible to more easily set the positions of the sheet processing to be performed on the sheet.

The sheet processing apparatus 20 includes the determiner (CPU 21). The determiner determines, from a job with the sheet processing, the face of the sheet at a time when the sheet reaches the sheet processing section on a basis of which face an image is formed on and a number of times of inversing of the sheet since image formation until arrival at the sheet processing section. The position reversing section (CPU 21) determines the direction of the face of the sheet conveyed to the sheet processing section based on the determination. Therefore, the user does not need to keep track of the sheet side at the time of cutting. Furthermore, it is possible to more easily set the positions of the sheet processing to be performed on the sheet.

The sheet processing apparatus 20 includes the reading section (image reading device 37) that reads an image formed on the sheet to be processed and that is placed on an upstream side from the sheet processing section. The position reversing section (CPU 21) determines the direction of the face of the conveyed sheet from the image read by the reading section. Therefore, the user does not need to keep track of the sheet surface at the time of cutting. Furthermore, it is possible to more easily set the position of the sheet processing to be performed on the sheet.

The image forming system (100, 200) includes the image forming apparatus 10 and the sheet processing apparatus 20. The image forming apparatus 10 includes: the image forming section 17 that forms an image on a sheet; and the sheet reversing section 18 that reverses the sheet on which the image is formed by the image forming section. The sheet processing apparatus 20 performs sheet processing on the sheet on which the image has been formed by the image forming apparatus. Therefore, it is possible to more easily set the position of the sheet processing to be performed on the sheet.

The program causes the computer of the sheet processing apparatus 20 with the sheet processing section (cutting device 30) that performs sheet processing on a conveyed sheet along a width direction orthogonal to a conveyance direction of the conveyed sheet to function as: the setter (CPU 21) that sets a sheet processing position from a leading end or a trailing end in the conveyance direction; and the position reversing section (CPU 21) reverses the set sheet processing position in the conveyance direction of the sheet according to a direction of a face of the conveyed sheet. Therefore, it is possible to more easily set the positions of the sheet processing to be performed on the sheet.

[Others]

Note that the description in each of the above embodiments is an example of the sheet processing apparatus and the image forming system according to the present invention, and the present invention is not limited to this. The detailed configuration and detailed operation of each unit constituting the apparatus can be changed as appropriate without departing from the scope of the present invention. Although embodiments of the present invention have been described and illustrated in detail, the disclosed embodiments are made for purposes of illustration and example only and not limitation. The scope of the present invention should be interpreted by terms of the appended claims.

For example, various additional components such as a relay unit may be provided between the sheet processing apparatus and the image forming apparatus.

The CPU 21 may display the cutting parameter setting screen shown in FIG. 4 or the cutting position correction screen shown in FIG. 6 on the operation display section 19 via the communication I/F 28.

Furthermore, in the above description, the sheet reversing path is provided in the image forming apparatus, but may be provided in the sheet processing apparatus.

In addition, the CPU 21, the ROM 22, the RAM 23, the storage section 24, and the setting input section 26 of the sheet processing apparatus 20 may be shared with the CPU 11, the ROM 12, the RAM 13, the storage section 14, and the operation display section 19 of the image forming apparatus 10, and processing in setting of various parameters relating to cutting of the sheet processing apparatus 20 may be executed by the shared configuration.

Furthermore, an external information-processing terminal such as a personal computer may be connected to the image forming apparatus 10 and the sheet processing apparatus 20 so that the information-processing terminal perform the processing performed by the CPU 21 of the sheet processing apparatus 20 in the above description. Further, various parameters for cutting may be input through an input interface such as a keyboard or a mouse provided in an information processing terminal such as a personal computer.

In this case, a configuration including an information processing terminal such as a personal computer may be regarded as the image forming system.

Furthermore, although the case in which the sheet P is used as the sheet has been described in each of the above-described embodiments, a material of the sheet is not limited to paper, and may be sheet-like resin or the like.

What is claimed is:

1. A sheet processing apparatus comprising:

a sheet processing section that performs sheet processing on a conveyed sheet along a width direction orthogonal to a conveyance direction of the conveyed sheet; and a hardware processor, wherein the hardware processor:

sets a sheet processing position from a leading end or a trailing end in the conveyance direction; and reverses the set sheet processing position in the conveyance direction of the sheet according to a direction of a face of the conveyed sheet.

2. The sheet processing apparatus according to claim 1, wherein the hardware processor switches the sheet processing position which is set using the leading end or the trailing end as a reference by switching the reference between the leading end and the trailing end.

3. The sheet processing apparatus according to claim 1, wherein the hardware processor sets the sheet processing position according to a distance from the leading end or the trailing end.

4. The sheet processing apparatus according to claim 1, wherein the hardware processor sets sheet processing positions as the sheet processing position on the sheet.

5. The sheet processing apparatus according to claim 4, wherein the hardware processor collectively reverses the set sheet processing positions.

6. The sheet processing apparatus according to claim 1, wherein the hardware processor corrects the sheet processing position set by the hardware processor by a user operation, and wherein the hardware processor reverses the corrected sheet processing position.

7. The sheet processing apparatus according to claim 6, wherein the hardware processor corrects the sheet processing position according to the distance from the sheet processing position set by the hardware processor.

8. The sheet processing apparatus according to claim 7, wherein the hardware processor corrects the sheet processing position using a leading end position or a trailing end position as a reference.

9. The sheet processing apparatus according to claim 8, further comprising:

a display section that shows information, wherein, at a time of the correction by the hardware processor, whether the sheet processing position is corrected using the leading end position or the trailing end position as the reference is shown on the display section.

10. The sheet processing apparatus according to claim 6, wherein, when the sheet processing is performed a plurality of times along the width direction orthogonal to the conveyance direction with respect to the sheet conveyed, a value of the correction by the hardware processor is settable for each sheet processing position, wherein the hardware processor reverses the value of the correction of the sheet processing position by reversing an application order of the value of the correction.

11. The sheet processing apparatus according to claim 1, wherein the sheet processing section is a first cutter that performs cutting processing to cut the sheet in the width direction orthogonal to the conveyance direction with respect to the conveyed sheet.

12. The sheet processing apparatus according to claim 11, further comprising:

a second cutter that is capable of cutting the conveyed sheet along the conveyance direction, wherein the hardware processor sets a cutting position using an end orthogonal to the conveyance direction as a reference, and wherein, when the hardware processor reverses the cutting position according to the direction of the face of the conveyed sheet, the hardware processor does not reverse the cutting position that is set using the end orthogonal to the conveyance direction as the reference.

13. The sheet processing apparatus according to claim 1, further comprising:

a storage section that stores the sheet processing position and the direction of the face of the sheet which are set by the hardware processor, wherein the hardware processor compares the direction of the face of the conveyed sheet and the direction of the face of the sheet stored in the storage section, and when the direction of the sheet conveyed and the direction stored in the storage section are different from each other, the hardware processor reverses the sheet processing position set by the hardware processor.

14. The sheet processing apparatus according to claim 1, wherein the hardware processor determines, from a job with the sheet processing, the face of the sheet at a time when the sheet reaches the sheet processing section on a basis of which face an image is formed on and a number of times of inversing of the sheet since image formation until arrival at the sheet processing section, wherein the hardware processor determines the direction of the face of the sheet conveyed to the sheet processing section based on the determination.

15. The sheet processing apparatus according to claim 1, further comprising:

a reading section that reads an image formed on the sheet to be processed and that is placed on an upstream side from the sheet processing section, wherein the hardware processor determines the direction of the face of the conveyed sheet from the image read by the reading section.

16. An image forming system comprising:

an image forming apparatus; and the sheet processing apparatus according to claim 1, wherein the image forming apparatus includes:

an image forming section that forms an image on a sheet; and a sheet reversing section that reverses the sheet on which the image is formed by the image forming section, wherein the sheet processing apparatus performs sheet processing on the sheet on which the image has been formed by the image forming apparatus.

17. A non-transitory computer-readable storage medium storing a program for a computer of a sheet processing apparatus, wherein the sheet processing apparatus comprises a sheet processing section that performs sheet processing on a conveyed sheet along a width direction orthogonal to a conveyance direction of the conveyed sheet, wherein the program causes the computer to:

set a sheet processing position from a leading end or a trailing end in the conveyance direction; and reverse the set sheet processing position in the conveyance direction of the sheet according to a direction of a face of the conveyed sheet.

* * * * *